US006754978B1

(12) United States Patent
Adams et al.

(10) Patent No.: US 6,754,978 B1
(45) Date of Patent: Jun. 29, 2004

(54) VACUUM TREATMENT OF WASTE STREAM

(75) Inventors: Randall G. Adams, Carthage, MO (US); Marshall R. Franklin, Carthage, MO (US)

(73) Assignee: Micronics, L.L.C., Carthage, MO (US)

( * ) Notice: Subject to any disclaimer, the term of this patent is extended or adjusted under 35 U.S.C. 154(b) by 0 days.

(21) Appl. No.: 10/269,920

(22) Filed: Oct. 12, 2002

Related U.S. Application Data

(60) Provisional application No. 60/329,089, filed on Oct. 13, 2001.

(51) Int. Cl.[7] ..... F26B 3/08

(52) U.S. Cl. ..... 34/361; 34/92; 34/361; 210/768; 210/770; 210/774; 210/784; 210/806; 426/478

(58) Field of Search ..... 34/361, 92, 368, 34/377, 380, 424; 426/478; 210/768, 770, 771, 774, 784, 806

(56) References Cited

U.S. PATENT DOCUMENTS

| | | | | |
|---|---|---|---|---|
| 1,945,860 A | * | 2/1934 | Laffler | 426/299 |
| 4,082,856 A | * | 4/1978 | Zwiep et al. | 426/299 |
| 4,731,164 A | | 3/1988 | Williamsom | 202/173 |
| 4,738,779 A | | 4/1988 | Carroll et al. | 210/512.2 |
| 5,185,087 A | | 2/1993 | Lister et al. | 210/787 |
| 5,429,750 A | * | 7/1995 | Steele | 405/129.25 |
| 5,462,661 A | | 10/1995 | Nasu | 210/206 |
| 5,507,958 A | | 4/1996 | White-Stevens | 210/774 |
| 5,772,901 A | | 6/1998 | Yu et al. | 210/896 |
| 6,052,917 A | | 4/2000 | Matsumoto | 34/138 |
| 6,176,376 B1 | | 1/2001 | MacNeil | 209/510 |

* cited by examiner

*Primary Examiner*—Henry Bennett
*Assistant Examiner*—Camtu Nguyen
(74) *Attorney, Agent, or Firm*—Jonathan A. Bay

(57) ABSTRACT

A method of vacuum drying sludge or slurry input material comprises providing a closed-ended vacuum tunnel with at least two interior augers. The tunnel has an interior bed recessed with adjacent troughs separated by a low partition for accommodating the two augers in closely-spaced generally-horizontal side-by-side relation. The augers are driven counter-rotating such the input material re-circulates in an endless loop down one auger, over to the other and back again. The augers have screws formed with stubby flights to form a cut-and-fold arrangement and disintegrate the material. The chamber is heated up to or over 70° C. and a current of air is suctioned into the tunnel through inlets and out through ports in part pull a slight vacuum in the tunnel as well as to suction up and draw out disintegrating fractions of the material including gasified fractions, waftable finely divided particulate fractions and other waftable fractions.

20 Claims, 15 Drawing Sheets

84
52
30

VACUUM TREATMENT OF WASTE STREAM

CROSS-REFERENCE TO PROVISIONAL APPLICATION(S)

This application claims the benefit of U.S. Provisional Application No. 60/329,089, filed Oct. 13, 2001.

BACKGROUND AND SUMMARY OF THE INVENTION

The invention relates to vacuum treatment or disintegration of a waste stream such as sludges or slurries of animal wastes produced by agricultural operations or alternatively municipal wastewater or other slurry streams. More particularly, the invention accomplishes disintegration and thereby liquid and particulate separation by various vacuum and heat drying treatments.

In cases of some input materials for treatment in accordance with the invention, useful end-products are obtained from all or fractions of the input stream. For example, in cases of treatment of egg-shell waste from an egg-producing or -utilizing operation, the treatment in accordance with the invention facilitates separating the shell from the membrane. The membrane matter obtained by treatment in accordance with the invention desirably contains collagen that is extractable by other processes still. The collagen-content of the membrane, after treatment in accordance with the invention, is optimally pathogen free:—that is, not merely allergen free or allergy tested but also pathogen free.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIGS. 13 through 15 comprise a series of views to show post-auger chamber treatment of the suctioned out material in accordance with the invention, wherein:

FIG. 13 is a side pictorial view of the return or transfer end of the vacuum auger chamber, and out from which end processed material is drawn or suctioned in part, showing initial stages for separating fractions of the suctioned out material, FIG. 14 is a pictorial view of a succeeding separation apparatus following the FIG. 13 apparatus (ie., namely the relatively larger cyclone in FIG. 13), and FIG. 15 is a pictorial view of yet another successive separation apparatus following the FIG. 14 apparatus.

DETAILED DESCRIPTION OF THE PREFERRED EMBODIMENTS

Figure 1:
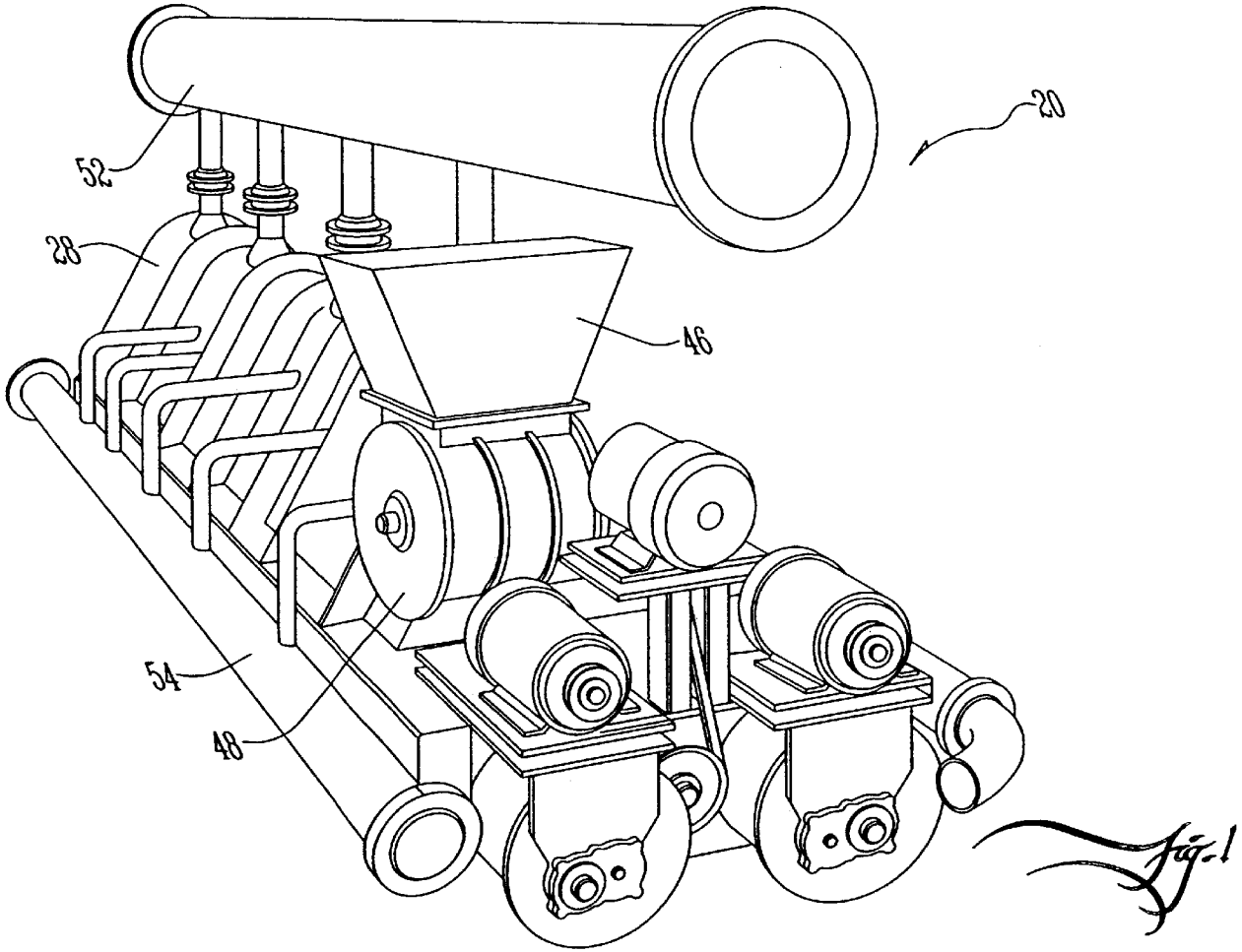
FIG. 1 is a pictorial view of vacuum drying treatment apparatus in accordance with the invention.

FIG. 1 is a pictorial view of vacuum drying treatment apparatus 20 in accordance with the invention. The vantage point of this view gives an end perspective from a high elevation of an infeed end of the apparatus 20, as can be reckoned by an infeed funnel 46 in the foreground. The infeed funnel 46 sits on top of a cylindrical air-lock gate 48 that in turn sits above a vacuum process chamber (not indicated by reference numeral view in this view but see reference numeral 25 in, eg., FIG. 4). An overhead vacuum header 52 occupies the highest elevation in the view. The overhead vacuum header 52 terminates in an open flange but in use, the open flange is connected by piping to a suitable high power vacuum source or pump (not shown by the drawings). Beneath the overhead vacuum header 52 is a hood 28 (ie., having an inverted-V shape and shown better by FIGS. 2, 3, 5 and 7). The hood 28 covers a base (see, eg., FIG. 7 for base 26 and hood 28), wherein the base 26 in isolation is shown more particularly by FIG. 9. Dual hot-air manifolds 54 comprise a pair of pipes flanking the opposite sides of the base.

Figure 2:
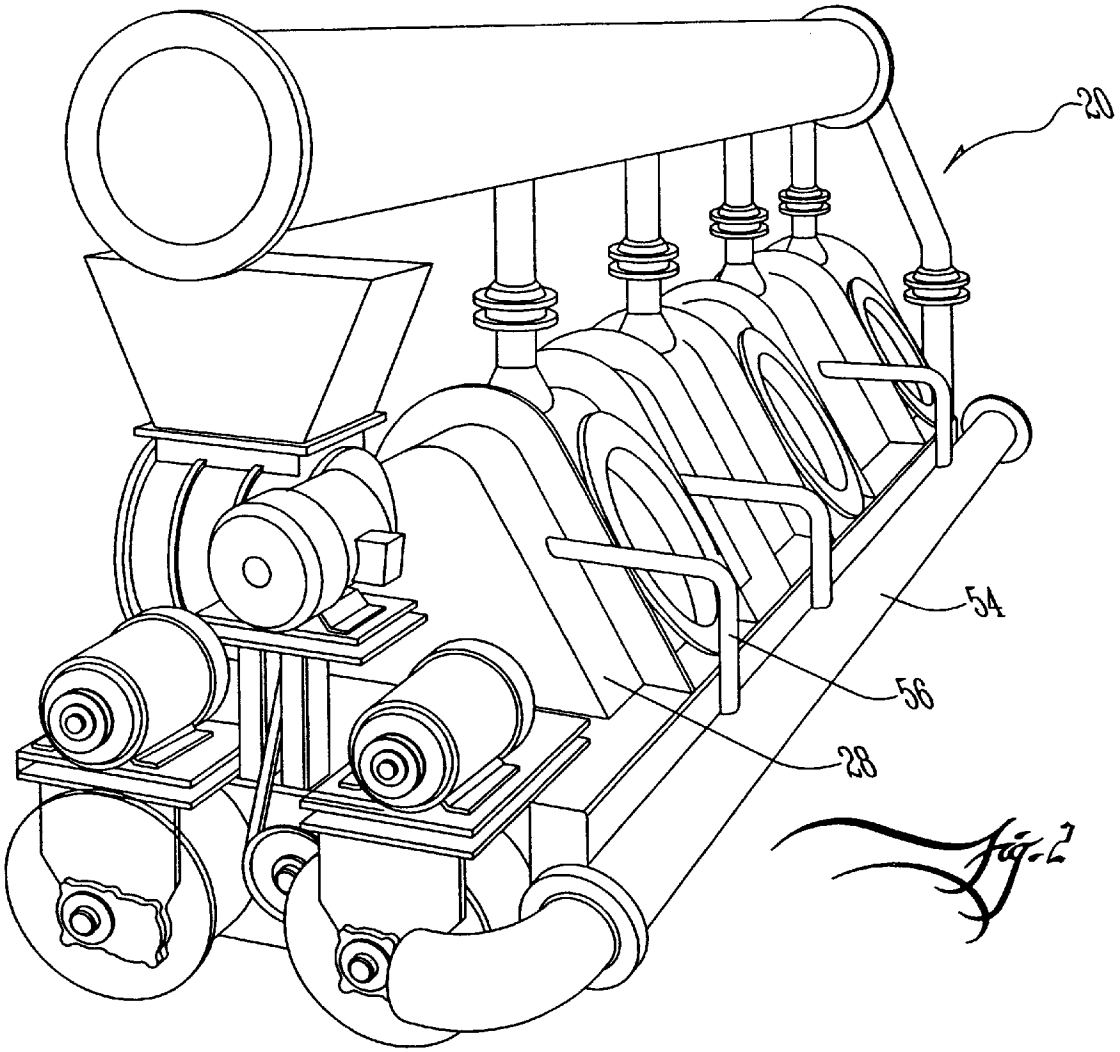
FIG. 2 is a view comparable to FIG. 1 except from a relatively lower-elevation vantage point and moved around by a small angular distance counter-clockwise so that the opposite side of the apparatus is more clearly in view.

FIG. 2 is a view comparable to FIG. 1 of the inventive apparatus 20 except from a relatively lower-elevation vantage point and moved around by a small angular distance counter-clockwise, so that the opposite side of the hood 28 (as well as the base 26, eg., see FIG. 9) is more clearly in view. The hood 28 is shown formed with three hatches which in use are to closed by windows to permit observation and study. This side's hot-air manifold 54 is formed with three (3) hot-air injectors 56 which are more particularly described in connection with FIG. 5.

Figure 3:
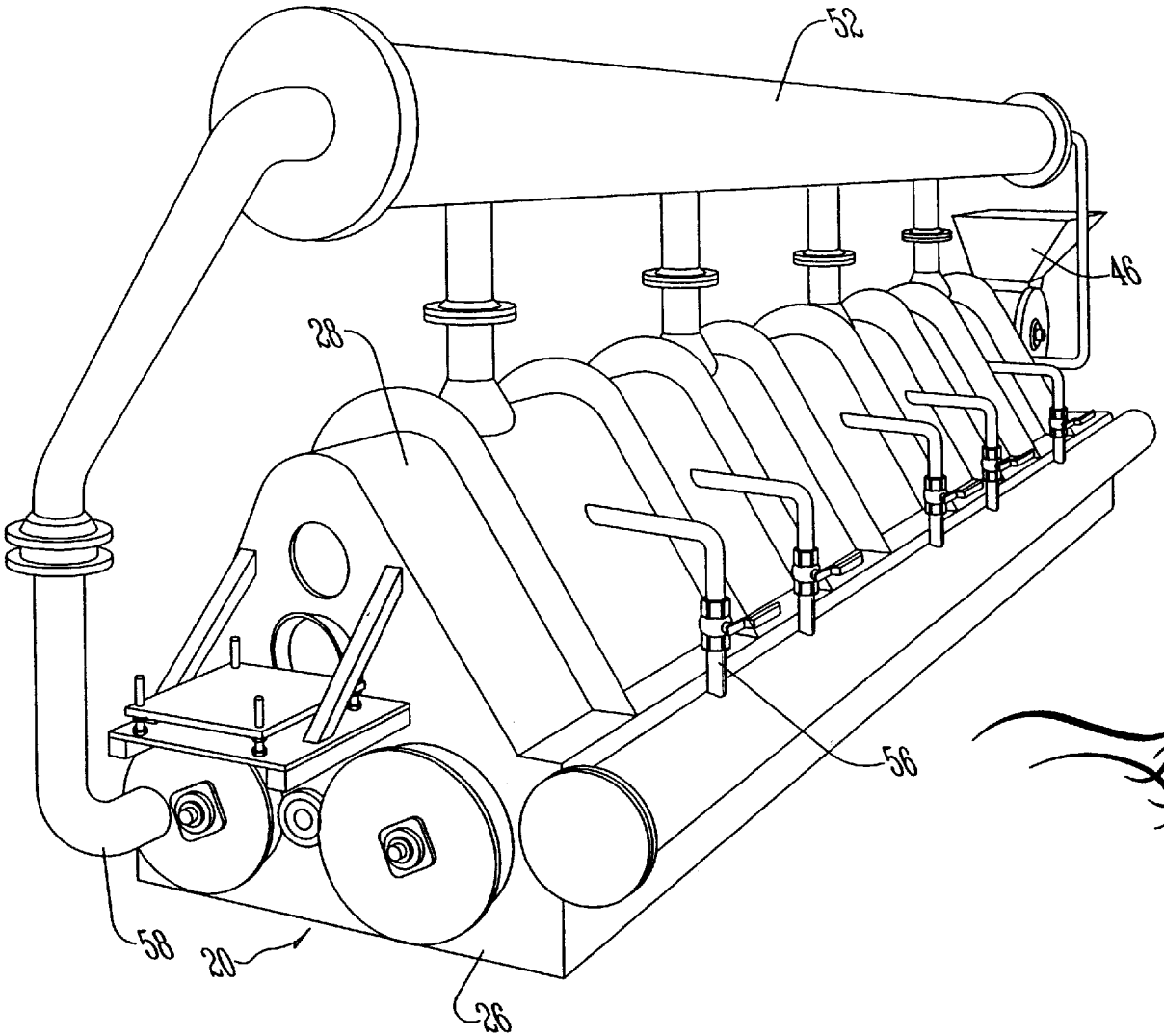
FIG. 3 is a view comparable to FIG. 2 except viewing the far end of the apparatus such that the (infeed) end that is in the foreground in FIGS. 1 and 2 is here in this view in the distance.

FIG. 3 is a view comparable to FIG. 2 except viewing the far end of the inventive apparatus 20 such that the input end that is in the foreground in FIGS. 1 and 2 is here in this view in the distance, as can be reckoned by the infeed funnel 46. This view shows that the generally-closed end of a vacuum header 52 (in the foreground) includes an eductor pipe 58 connected to a drain at the bottom of the vacuum drying chamber 25 formed by the hood 28 and base 26. The eductor drain 58 permits periodic syphoning out of irreducible fractions that resist from being suctioned out of the top of the hood 28 as airborne dust. The hood's flank on this side is formed with five (5) hot-air injectors 56.

Figure 4:
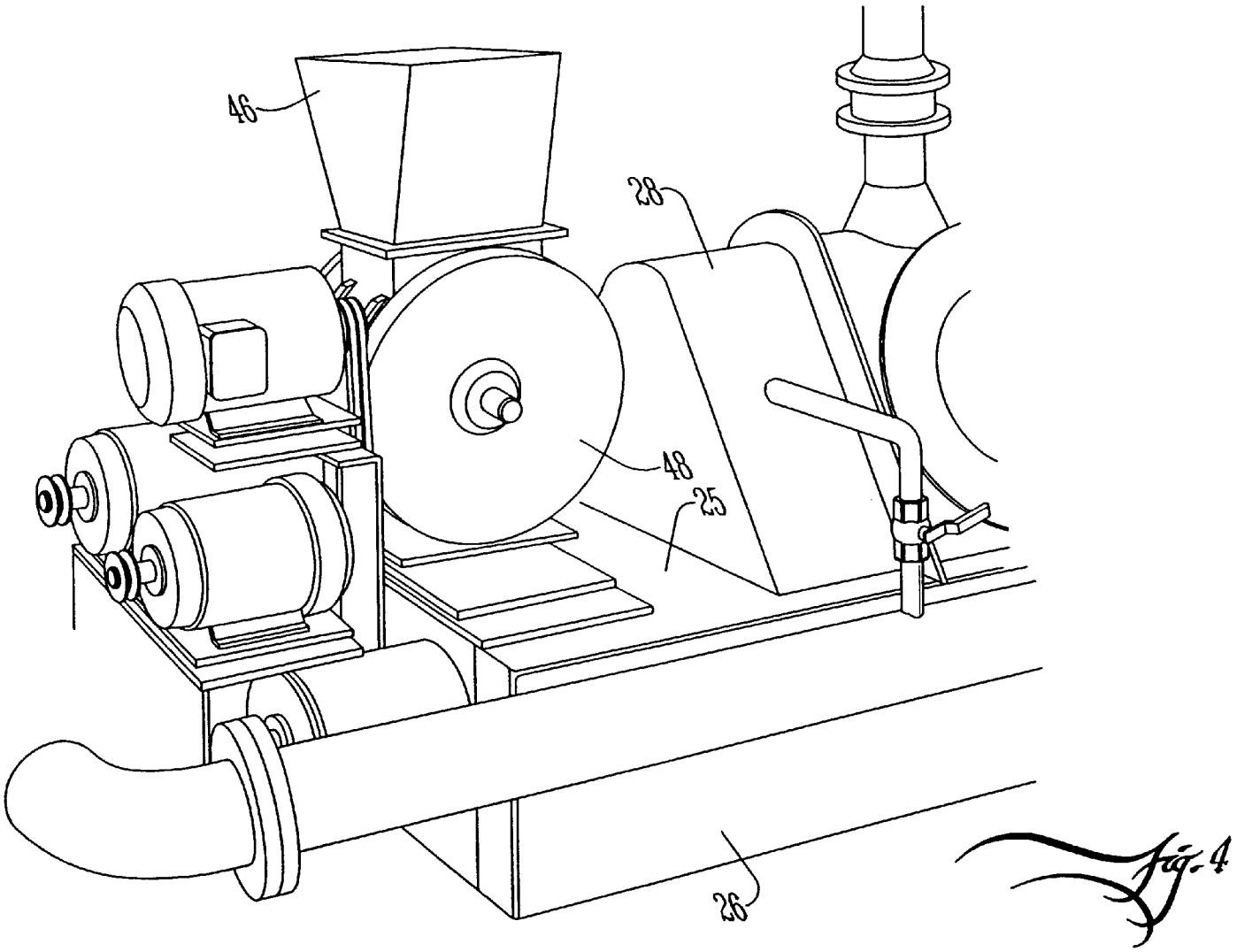
FIG. 4 is a side perspective view of an air-lock gate on the apparatus' infeed end.

FIG. 4 is a side perspective view of the infeed funnel 46 and its sub-attached air-lock gate 48, as well as the input end's motor bank. The air-lock gate 48 comprises a nearly-cylindrical body sandwiched between opposed flat sidewalls (only near side flat sidewall in view) between which span a hoop side wall. Inside the cylinder body (but not in view) are the vanes of an enclosed vane gear. The enclosed vane gear is driven to rotate. Material introduced in the top of the hopper falls into the vanes, and is rotated by the vanes to drop out of the air-lock gate through an open bottom (not in view) into the vacuum drying chamber 25. The vanes form a seal by scraping between the opposed flat sidewalls and scraping past the hoop sidewall to seal in the vacuum in the hooded, vacuum drying process chamber 25 (ie., formed by the closure between the hood 28 and base 26). The motors in the view supply the drive power for the air-lock gate 48 (as well as the internal augers, grinders and paddles not in view but shown by, eg., FIGS. 5, 6 and 8).

Figure 5:
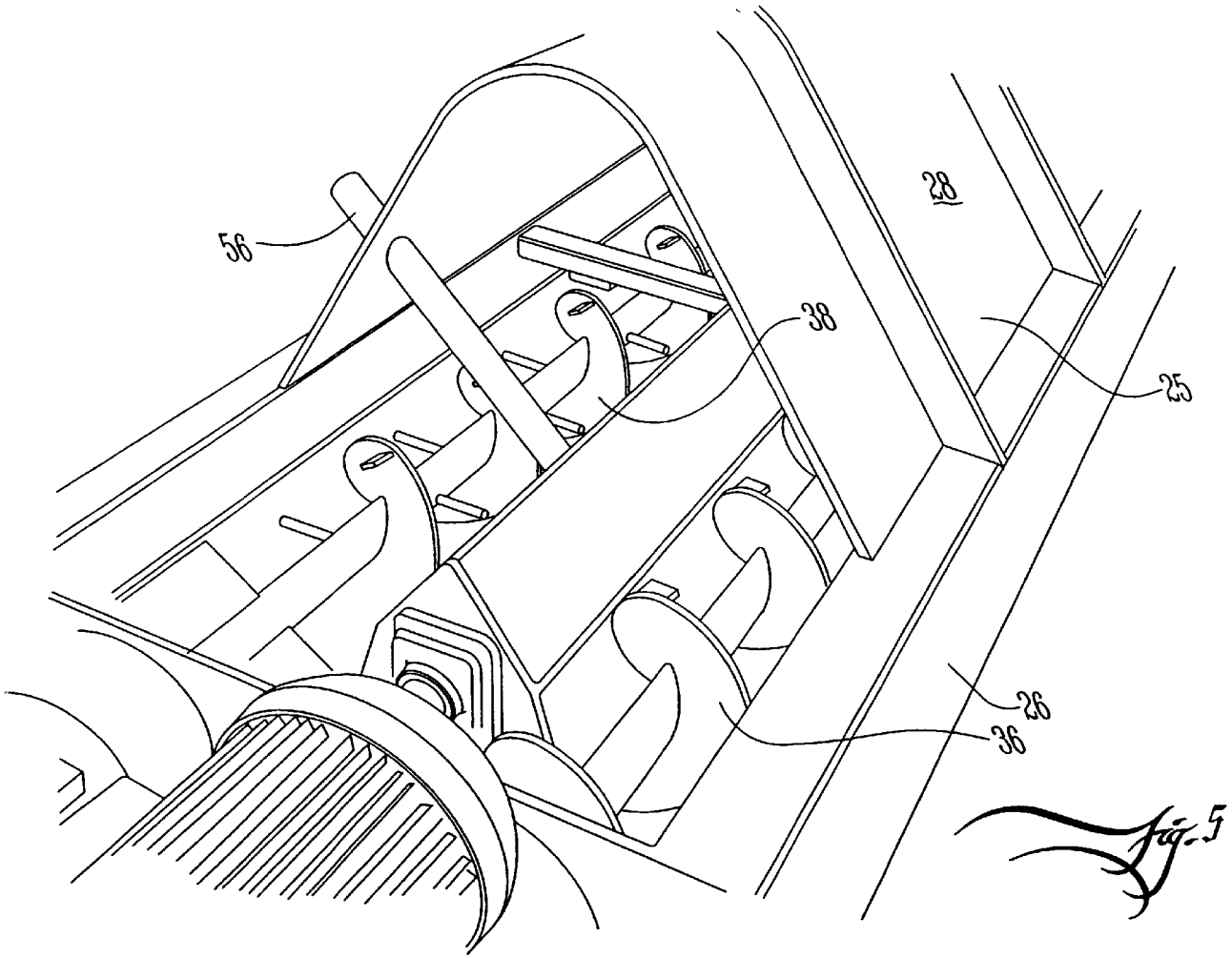
FIG. 5 is an lengthwise top perspective view of the infeed end of the vacuum drying apparatus, with a foreground portion of the hood removed from view for clarity of viewing various internal components.

FIG. 5 is an lengthwise top perspective view of the input end of the vacuum drying chamber 25 and base 26, with a foreground portion of the hood 28 removed from view for clarity of viewing various internal components. More particularly, the infeed funnel and air-lock gate are removed from view, as is a foreground section of the hood 28. The view shows a set of tandem augers 36 and 38 resting in their respective troughs (not indicated by reference numerals in this view but see FIG. 9). One air jet nozzle 56 that is representative of the series of others is shown extending through the hood 28 and aimed directly at the auger 36 on the opposite side of the chamber 25, and angled down at about 45°.

Figure 6:
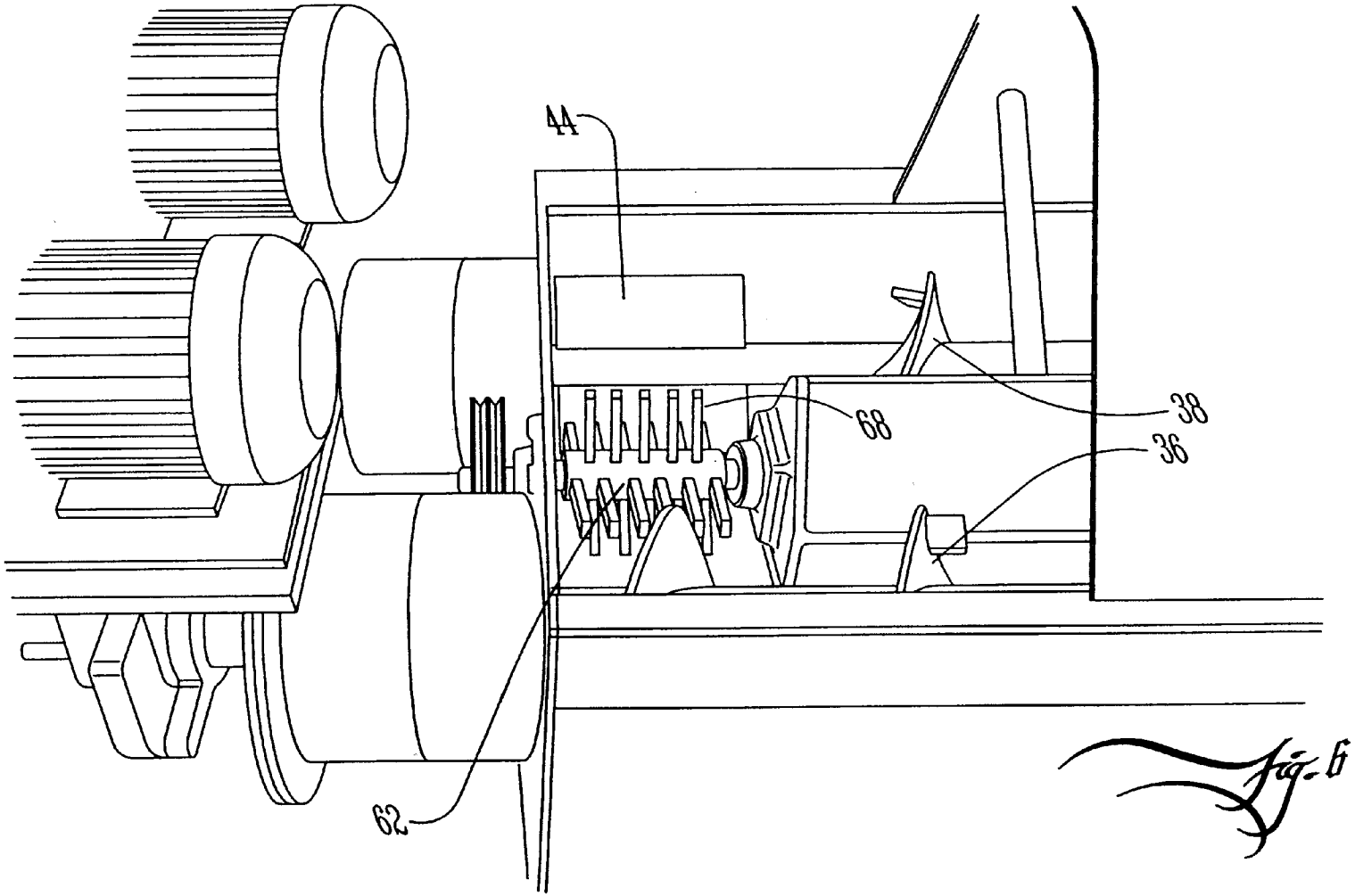
FIG. 6 is a lateral top perspective view of the structure of FIG. 5 wherein this view shows a grinder occupying a central position between tandem augers in the infeed section of the vacuum drying apparatus.

FIG. 6 is a lateral top perspective view of the structure of FIG. 5 wherein this view shows an input-end grinder 62 occupying a central position between the tandem augers 36 and 38. The grinder 62 bristles with four axial rows of spokes 68. In addition, this view also shows the pair of paddles 44 on the return-auger's terminal end (ie., one is up and the other down). With reference to FIG. 1 or 2, material introduced through the air-lock gate lands on the paddles, which kick the material into the grinder 66, the ejection from which feeds the primary auger 36 in the foreground. To be clear, the foreground auger is the primary auger 36 as the far side auger is the return auger 38. The far-side or return auger's screw terminates short of the grinder 62 and is there provided with the at least two diametrically opposed paddles 44. Hence the paddles 44 are fixed to the same shaft as the return auger 38. In a preferred embodiment, the auger/paddle shafts are driven at speeds adjustable between about five and eighty r.p.m. (ie., simultaneously), and the grinder 62 is driven at speeds up to about 850 r.p.m. The end of the shafts opposite to what is in view here in FIG. 6 (which is, ie., the transfer end) is constructed with a like arrangement of paddles and grinder, except that the primary auger 36's shaft (ie., the one in the foreground) is outfitted with paddles. With reference back to FIGS. 2 and 3, they show that there are five (5) hot air injectors trained on the primary auger 36 while there are three (3) hot air injectors trained on the return auger 38.

Figure 7:
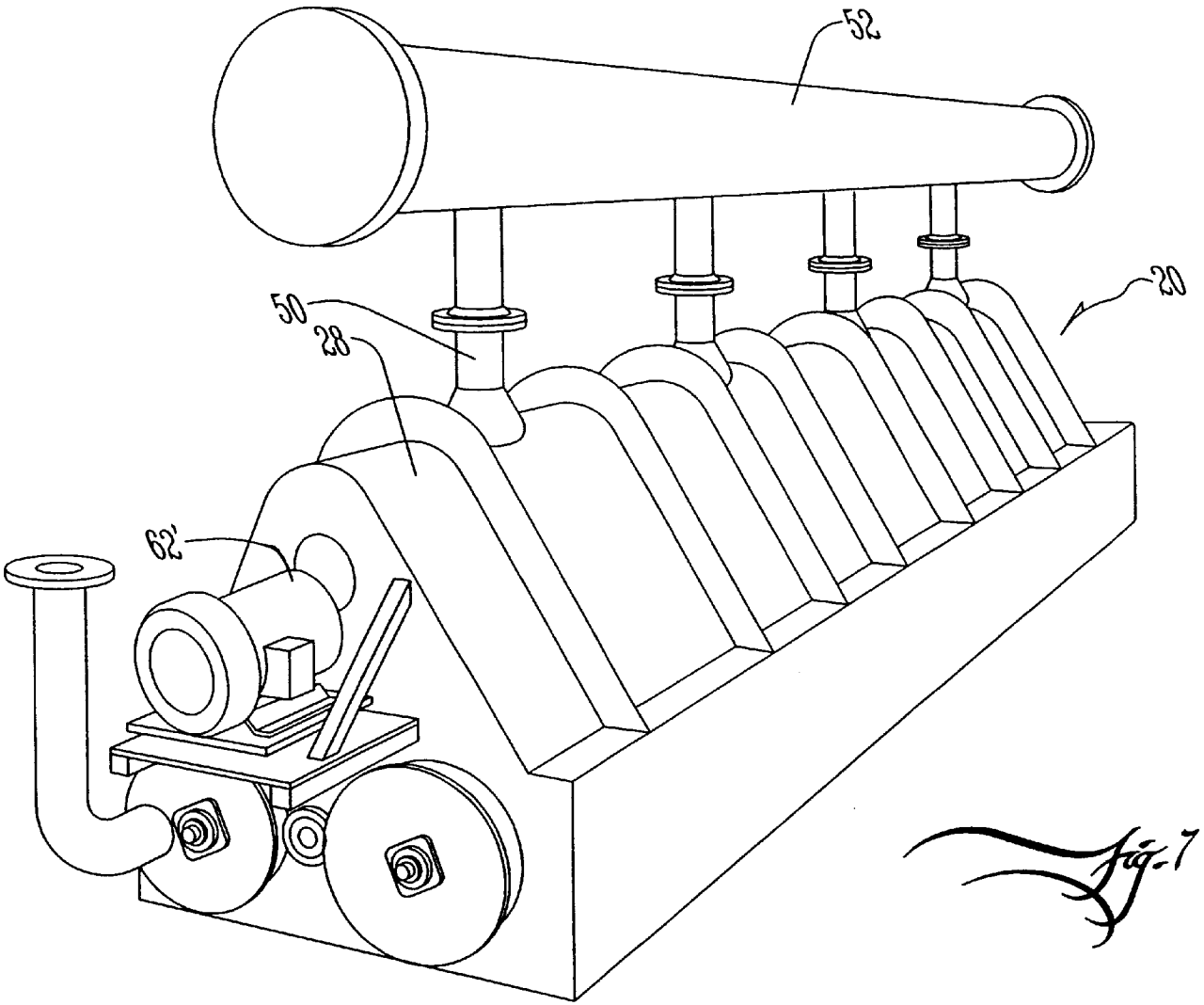
FIG. 7 is an end elevation view of the end of the apparatus opposite the infeed end, which end serves as a transfer or return end for a re-circulating loop of material within the apparatus.

FIG. 7 is an end elevation view of the transfer or return end of the apparatus 20 shown by FIG. 6. This view shows another motor 62' for driving the grinder in the return end. The overhead vacuum header 52 is shown blanked off in this view but is preferably adapted with the eductor pipe 58 (eg., syphon-like pipe) shown in FIG. 3. In this embodiment, overhead vacuum header 52 has four (4) suction ports 50 apertured in the top of the hood 28.

Figure 8:
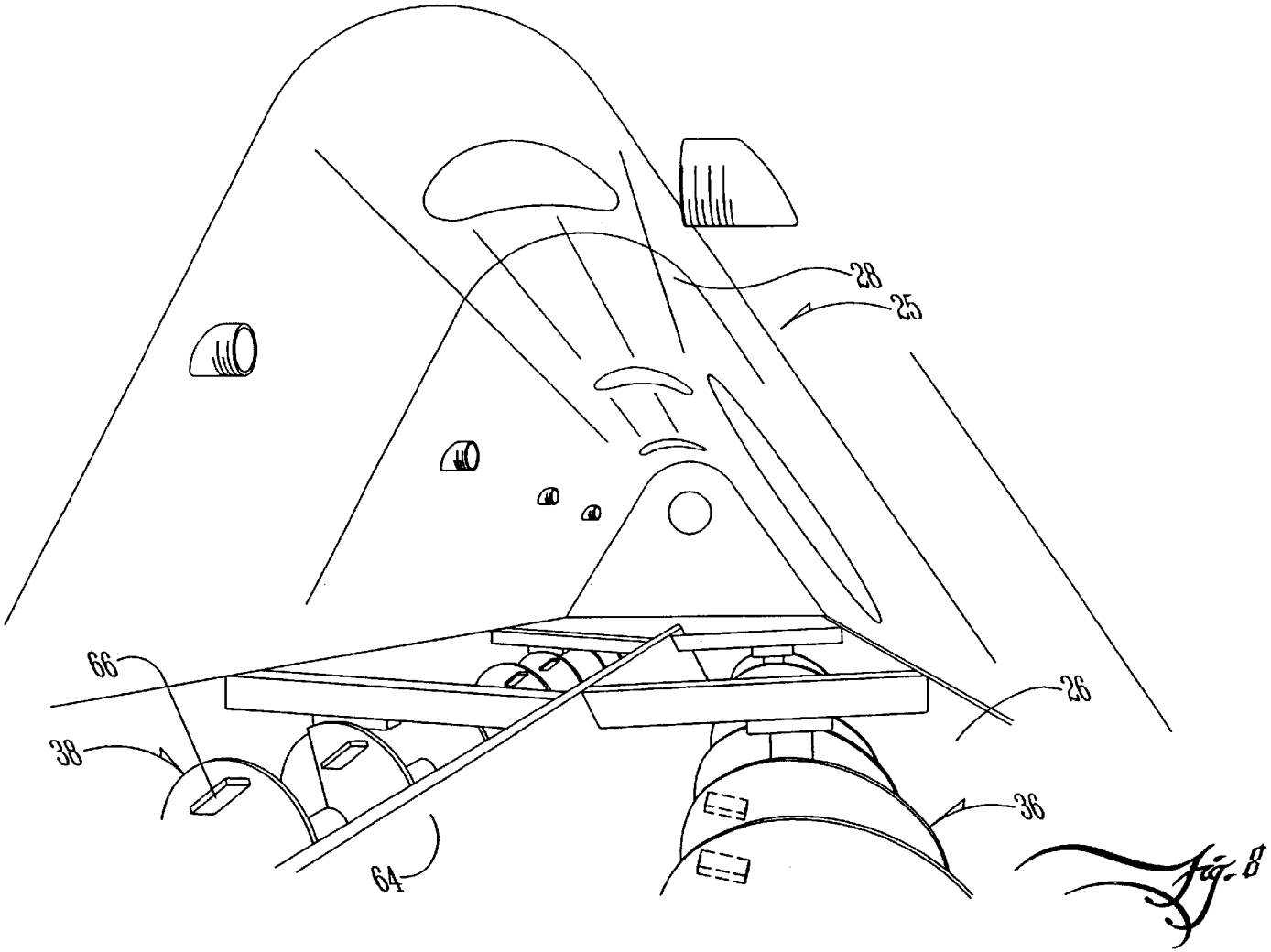
FIG. 8 is a longitudinal view inside the vacuum drying apparatus with the hood in place.

FIG. 8 is a longitudinal view inside the vacuum drying chamber 25 with the hood 28 in place. The base 26 of the chamber 25 is elongated to hold the tandem augers 36 and 38 as shown, each which in this embodiment measures about eighteen feet (5½ m) long by about twelve inches (~⅓ m) in diameter. The augers are partitioned by a central low crown 64 with sloping side walls. This view shows the cut-and-fold construction of the augers, meaning that the screws are sporadically attached with stubby flights 66 as shown. It is a preferred option if—at varying axial locations along the auger shafts—a gap is formed in the screw and is instead replaced with intermediate thrashers (none of these are in view in the drawings). Briefly, such preferred thrashers would comprise spoke rods that further pulverize the passing material.

Figure 9:
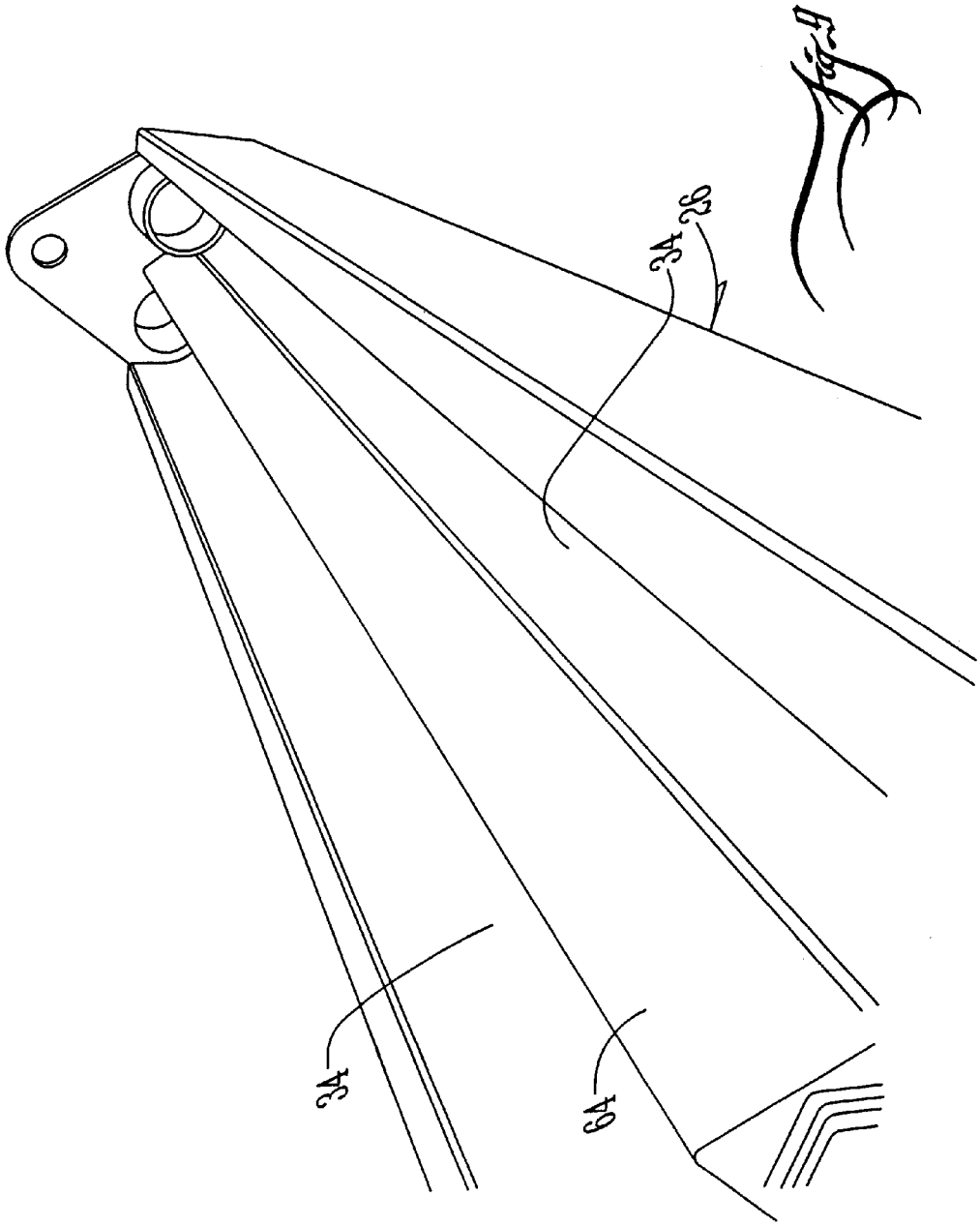
FIG. 9 is a lengthwise view comparable to FIG. 8 except with the hood and augers removed from view.

FIG. 9 is a lengthwise view comparable to FIG. 8 except with the hood and augers removed from view. The base 26 is formed with the tandem troughs 34 as shown, partitioned by the central crown 64.

Figure 10:
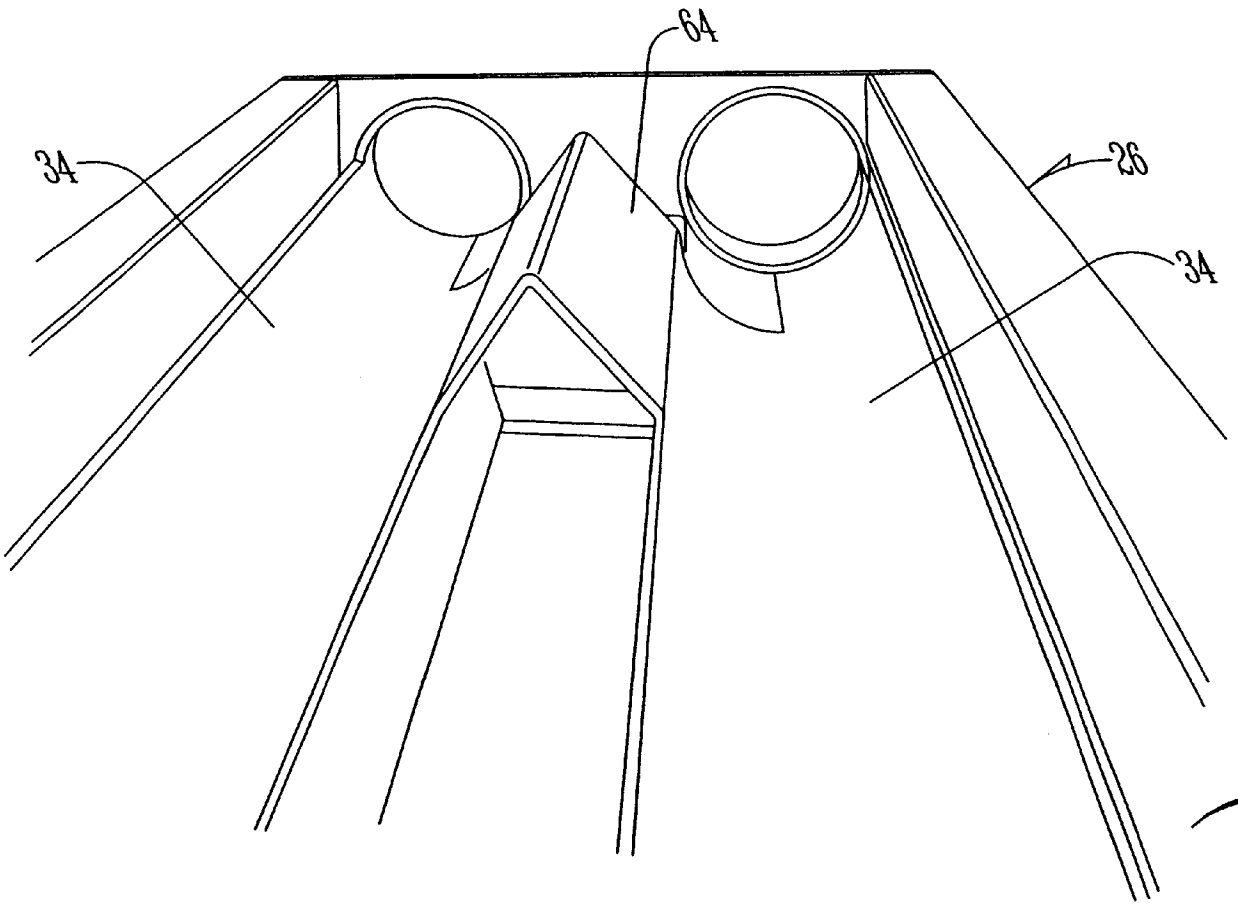
FIG. 10 is a close-up section view comparable to FIG. 9 except showing a pair of auger troughs partitioned by a low, crowned partition, which is shown in section to depict aspects of a water jacket.

FIG. 10 is a close-up section view comparable to FIG. 9 except showing the central crown 64 in section to depict aspects of the water jacket that constitutes the base 26.

Given the foregoing, in cases in which the invention 20 is used to treat poultry manure, the introduced material will typically average 70% chicken manure with a moisture content averaging between a range from 30% to 90% moisture. By means of the injected hot air and the water-heated base 26, the chamber 25 is kept at about between ~180° F. and ~200° F. (ie., ~80° C. and ~90° C.). Water, for example, boils at 166° F. at twenty inches of mercury (ie., ~75° C. at $\frac{2}{3}^{rds}$ an atmosphere). The design operating pressure for the chamber 25 is between about twenty and twenty-four inches of mercury (ie., ~$\frac{2}{3}^{rds}$ and $\frac{4}{5}^{ths}$ of an atmosphere). The design throughput of material is about 500 lbs (~225 kg) per minute, or in other words about 15 tons (~13½ metric tonnes) per hour.

A more particular description of the invention can be presented as follows. The invention comprises a method and apparatus for vacuum treatment of waste streams such as sludges or slurries of animal or biologic wastes produced by agricultural operations like poultry farms or poultry-product food operations. The invention however has broader application than poultry materials. Poultry waste can be reckoned alternatively as either manure materials or else as egg materials including primarily broken shells and membrane. It is an object of the invention to render useful end-products from treatment in accordance with the invention. For example, in the case of manure materials it is desirable to obtain pathogen-free fertilizer from the input stream. Alternatively, in the case of egg materials it is desirable to obtain pathogen-free membrane from the input stream, wherein the output membrane is also free of shell bits and dust as will be more apparent in connection with the following discussion of preferred embodiment and examples. Additionally, the recovered shell bits and dust can be utilized for its calcium and other minerals and constituent materials.

In general, the invention comprises a sequence of operations including, briefly, an optional pre-treatment of the supply material for enhancing effectiveness of the succeeding vacuum and drying treatment, and then a series of optional post-treatment operations such as separation of the vacuum treatment's discharge into further fractions.

The inventive method is carried out by among other things an inventive chamber 25 for carrying out a vacuum drying process. At some stage in the sequence of events an input material such as a slurry, sludge, or some other semi-liquid-solid material (eg., generically, slurry or waste material) gets introduced into the vacuum drying chamber 25. Preferably this is done in a regulated fashion through an air-lock gate 48. That way, the air-lock gate 48 allows the vacuum drying chamber 25 to remain at a relatively evacuated pressure while the waste material is introduced. The vacuum drying chamber 25 rests on an electronic scale(s) (not shown), and the scale(s) provide signals to a control system (not shown). The control system is configured for automating much of the inventive method, including controlling the introduction of the input slurry or waste material into the vacuum drying chamber 25. As the vacuum drying chamber 25 becomes lighter though removal or discharge of diverse streams of treated material, a low weight condition is sensed by the control system from monitoring the signals from the electronic scale(s). In response, the control system calls for introduction of more input material until the vacuum drying chamber 25 weighs as heavy as a high weight condition.

The supply of the input material to the air-lock gate 48 is optionally handled with pre-treatment apparatus that are more particulary described in connection with FIGS. 11 and 12 hereof. FIGS. 1, 2 and 4 show simply a disconnected infeed funnel 46 sitting on top of the air-lock gate 48. Briefly for now, the input material fed by the pre-treatment apparatus described in connection with FIGS. 11 and 12 get channeled down into the air-lock gate 48. The air-lock gate 48 has a construction to transfer material from an intake side to an output side while isolating pressure differences between the two sides. In other words, the air-lock gate 48 prevents room pressure from excessively leaking into the chamber 25 and thereby wrecking the vacuum. The construction of the air-lock gate 48 includes internal vanes (not shown) that are driven to rotate about a horizontal axis through full turns. As the vanes rotate from a top or intake position to a side position they form a vacuum seal by the vanes' lateral edges being closely flanked between opposed flat sidewalls of the air-lock gate 48's cylindrical housing, and by the vane's terminal edges closely scraping by the cylindrical housing's hoop sidewall. At the bottom or output position of their turning, the vanes empty the carried material through an open bottom directly into the vacuum drying chamber 25. The air-lock gate 48 is controlled by the control system (again, not shown) to introduce measured amounts of material as needed. This can be achieved by ON and OFF control, or by slowing or speeding up the drive of the vanes to gain some measure of proportionate control, or by a combination of such options among others.

Inside the vacuum drying chamber 25, it has a pair of tandem re-circulating augers 36 and 38. That is, the augers 36 and 38 lay side-by-side and extend between an input end and a transfer end. One auger 36 serves as the primary run as the other auger 38 serves as the return run. The vacuum drying chamber has disposed inside itself, at the input end, a distinctly separate grinder section 62.

The grinder section 62 is disposed on a turning axis approximately parallel to the axes of the two augers 36 and 38. In FIG. 6 the grinder 62 is shown approximately centered between the ends of the two augers 36 and 38 (ie., and at the input end of the chamber 25). In FIGS. 11 and 12 the arrangement of the alternate embodiment of the invention differs a little. Returning to FIG. 6, the grinder section 62 has a central shaft that bristles with four rows of radial spokes 68. In each row, the spokes 68 are spaced apart from one another by a gap approximately the width of one spoke 68. In other words, each row comprises an axial-progression of spoke 68, gap, spoke 68, gap and so on, to the end of the progression. Each row (ie., each axial series) of spokes 68 is arranged about 90° apart from the neighboring row(s) around the grinder 62's central shaft. That way, alternate rows of spokes are diametrically opposite from one another as well intermediate the flanking intervening rows. Indeed, each spoke 68 in a given row is diametrically opposite a spoke 68 in the respective alternate row. In contrast, each spoke 68 in a given row is axially-staggered from the spokes 68 in the flanking rows and, therefore, a spoke 68 in a given row actually aligns with gaps in the flanking rows 68.

In use, the input material dropping in from the air-lock gate 48 is dropped onto the terminal end of the return auger 38. Both augers 36 and 38 are characterized by a central drive shaft formed with external screws (eg., the spiral windings on the drive shafts). The return auger 38's terminal end is characterized by a gap defined by termination of the screw, and in this gap—ie., between the cessation of the screw and the wall of the input end of the vacuum drying chamber 25—the return auger 38's shaft carries a pair of diametrically-opposed paddles 44. Each paddle 44 is simply a straight vane-like structure which operates to scrape material out of the bottom of the terminal end of the return auger 38's trough 34, and flip it into the grinder 62. As soon as the scraped up material is flipped into the grinder 62, the spokes 68 pulverize the material, and kick it as by ejecting it over onto the input end of the primary auger 36. The screw of the primary auger 36 transports the material down the primary run to the transfer end. The transfer end has a like paddle-and-grinder arrangement as the input end (see, eg., the grinder motor 62' for the transfer end in FIG. 7). That is, the 'screw of the primary auger 36 terminates short of the chamber 25's end wall at the transfer end (this is not shown) to form a gap. This gap is filled with a like pair of paddles that scrape the bottom of the primary auger 36's trough 34 and flips the material into the transfer-end's grinder (eg., 62', although none of the foregoing structure is shown in the drawings). The transfer-end grinder (eg., 62') likewise pulverizes the material it receives and also kicks or transfers over the residual material into the start of the return auger 38. The screw of the return auger 38 motivates the ever disintegrating or reducing material to the point of origin, ie., the input end's paddle-and-grinder arrangement 44/62. There, the ever-disintegrating residual material is mixed in with newly introduced material by way of the air-lock gate 48. The mixture of newly-introduced material and leftover residual material (ie., as returned by the return auger 38) are hence started down the primary augur 36. By these means the material is re-circulated in such fashion as a continuous loop.

FIG. 8 shows that the screws of the augers 36 and 38 have a series of flights 66 (eg., only in view for the return auger 38) attached to them. Sometimes this arrangement of screw and flights is referred to as a cut-and-fold arrangement. These flights 66 kick up or fluff the material along the way. The augers 36 and 38 turn counter-rotating relative each other. In particular, in FIG. 8, it is preferred if the primary auger 36 (on the right in the view) turns counter-clockwise as the return auger 38 (on the left) turns clockwise. That way, the tandem augers 36 and 38 toss material at each other over the low partition 64 between them. Trials show that after three or four minutes of treatment, a large fraction of the introduced material is reduced to substantially gaseous or finely-divided material which can be uplifted and suctioned out the suction ports 50. Of what remains, the primary auger 36 wins out over the return auger 38 and the such remaining material is transported by the primary auger 38 to a solid-material eductor exit (eg., 58) described more particularly below. The augers 36 and 38 are driven at speeds adjustable in a preferred range of between about five and eighty r.p.m.

The tandem augers 36 and 38 rest in a base 26 formed with dual auger-troughs 34 and 34 spaced by the above-mentioned low partition 64. The base 26 is covered by and sealed over with a hood 28.which in some views including FIG. 8 has inverted-V shape. The base 26 is heated by means of being constructed with a surrounding water jacket. Water heated to ~200° F. (~90° C.) is circulated through the water jacket to provide one source of heat to the vacuum drying chamber 25. The combined effects of vacuum and heat starts the drying of the material, causing among other effects the vaporizing of water and other volatile and/or vaporizable components. The material reduces to becoming an ever drier and disintegrating solid fraction, eventually reducing into dust or that is, a lightweight particulate capable of being suctioned out of the chamber 25 by a source of suction. The vaporizable and volatile components as well as the particulate material capable of being suctioned out this way are continually drawn out of the vacuum drying chamber 25 through the suction or exhaust ports 50.

Pause can be taken at this point, and the foregoing brief overview can be slightly expanded upon in the following respects. To accomplish drying, the introduced material is conveyed around the re-circulating loop 36 and 38 in an out-and-back fashion by the tandem, side-by-side augers 36 and 38. The augers 36 and 38 rest in a narrow, elongated base 26 formed with dual auger troughs 34 and 34. The base 26 including the troughs 34 is(are) heated by hot water circulating in the base 26's water jacket. As the material is motivated along the primary auger 36's run and then returned back by the return auger 38's run, the material is heated in the evacuated pressure of the vacuum drying chamber 25 such that vaporizable and volatile components are given off by the material (eg., such components "flash"). The augers 36 and 38 cause agitation and disintegration of the reducing material by having a cut-and-fold construction. Optionally, the screws of the augers 36 and 38 are gapped in places and replaced by thrashing spokes (not shown), which further agitate and break up the reducing material. The reducing material is transferred between the augers at each end by the sets of spokes 68 of the grinders 62. The grinders 62 significantly contribute to the pulverizing and/or disintegration, or reduction of the material into a fine particulate. Hence the reducing material is reduced from being slurry to sludge, then clumps (or "balls") by a succession of transforming into ever smaller gradations of fineness. The material is constantly subjected to drying and agitation and thus is constantly losing its cohesiveness.

Moreover, the material is subjected to several jets of hot air (ie., by means of injectors 56). The injectors 56 of the hot air jets are aimed directly onto the material while motivated by the augers 36 and 38 (see, eg., FIG. 5). These injectors 56 are disposed at several points in the primary and return runs 36 and 38. The hot air injectors 56 not only promote drying but also enable the swirling entrainment or "uplift" of the reducing material in the form of dust or fine particulate. The uplifted dust (or fine particulate) is light enough to be suctioned out the suction ports 50 in the top of the hood 28. Whatever fraction of the reducing material that survives the primary run 36 is then handled at the transfer end by being shoved into a flailing grinder (eg., 62'), which further breaks up the material into clouds of dust for suctioning out the suction ports 50 in the hood 28. The transfer end's flailing grinder (eg., 62') further facilitates reduction of the material. Material which survives the transfer end's grinder (eg., 62') is subjected to the same treatment in the return run 38, eg., heating and agitation by various means including the hot air injectors 56.

The throughput rate of the material is controlled such that predominantly all but a fraction of the material is reduced by the time it returns to the point of origin, ie., the input end. If not reduced and uplifted yet, the persisting material is continually re-circulated through the circuit 36 and 38, undergoing the various punishments including pulverizing by the grinders 62 at both ends, cutting and folding by the screws of the augers 36 and 38 and their stubby flights 66, thrashing by the thrashers (if any), and the heating and the air injectors 56 and then ultimately the vacuum (eg., header and ports 52 and 50). Nevertheless, after an extended period of operation, an irreducible fraction accumulates sufficiently that it is extracted out of the troughs 34 by various drains including an eductor drain 58 (eg., more nearly a syphon) as shown by FIG. 3 for this purpose.

Given the foregoing, the material is predominantly vaporized, disintegrated or atomized, and/or beaten into such a cloud of dust that it can be suctioned out the vacuum ports 50. The suctioned out material is essentially pathogen free.

The suction ports 50 are coupled to a powerful source of vacuum (not shown). Under preferred operating conditions, the source of vacuum evacuates the chamber 25 down to a vacuum pressure of between about twenty and twenty four inches of mercury (ie., ~$\frac{2}{3}^{rds}$ and $\frac{4}{5}^{ths}$ of an atmosphere), which includes vacuuming out the air introduced in the form of the hot air jets 56. Accordingly, a substantial exhaust of air, vapor and/or volatile components as well as entrained dust/particulate exits out of the vacuum drying chamber in a rush through the vacuum ports 50. The suctioned-out stream is pulled out through the vacuum header 52 which preferably incorporates a series of venturi jets (not shown), perhaps four or so, which are specially restricted nozzles designed to accelerate the flowrate of the suctioned-out stream that is drawn out of the chamber 25.

Since the venturi jets do act to drop the temperature of the suctioned-out stream, features are included to counteract the temperature drop because if it were not, the temperature drop would condense some of the vapor and then perhaps dampen the dry dust, perhaps leading to agglomeration and clumping. However, the features which counteract the temperature drop at the venturi jets include sources of heat like thermal water jackets for heating up the vacuum header 52 to the vacuum drying chamber 25's temperature. Thus, this keeps the exhaust stream hot until further processed for separation. The vacuum header 52 might optionally be constructed with internal impingement surfaces, such as a fixed screw to swirl the output stream or the like, which among other things keeps the output stream swirling in a state of turbulence.

Figure 11:
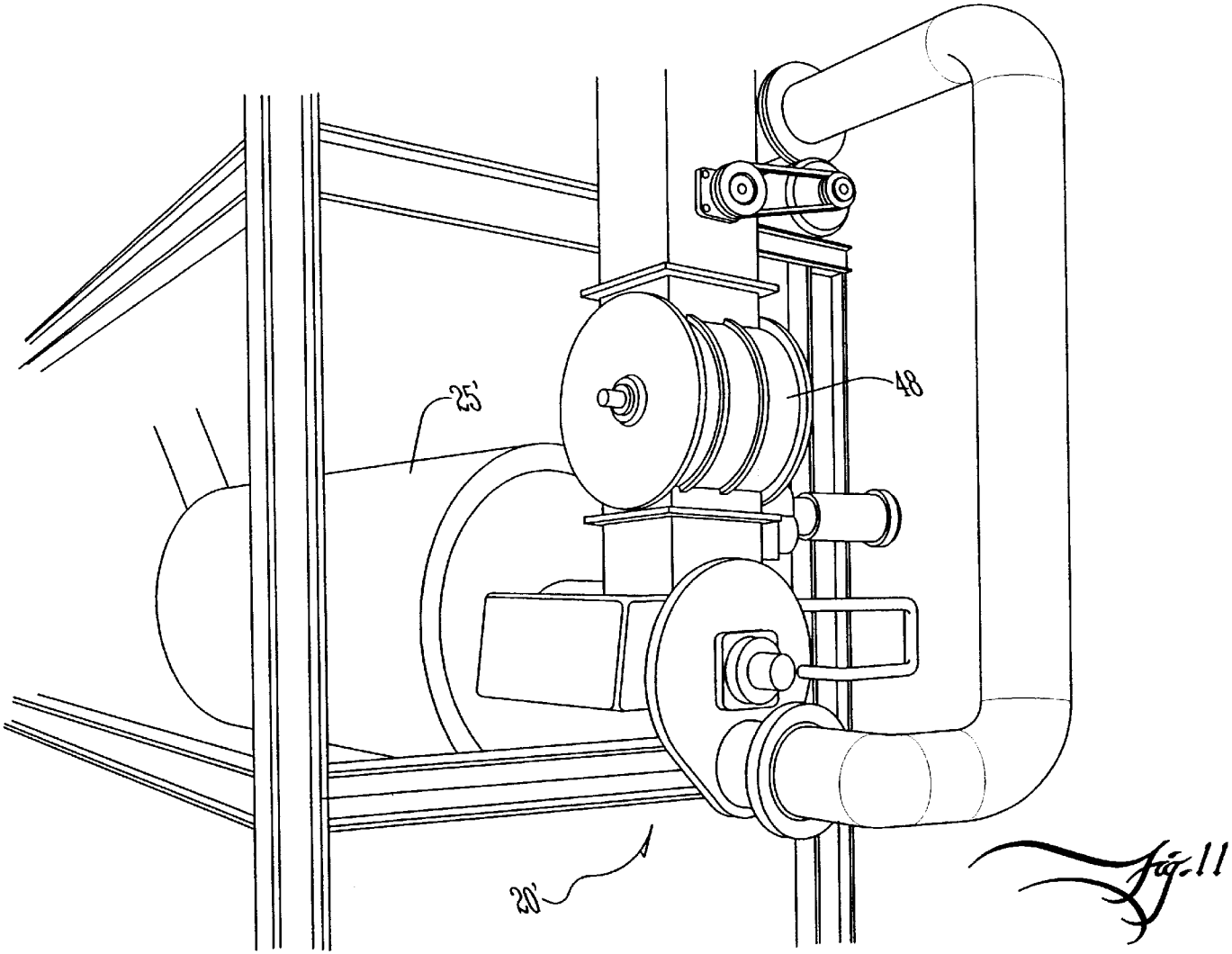
FIG. 11 is a pictorial view comparable to FIG. 1 except showing an alternate embodiment of the vacuum drying treatment apparatus in accordance with the invention.

To turn now to FIG. 11, it is a pictorial view comparable to FIG. 1 except showing an alternate embodiment 20' of the vacuum drying treatment apparatus in accordance with the invention. Additionally, this alternate vacuum drying chamber 25' is mounted elevated on scaffolding, the hood and base thereof (hidden from view) being wrapped inside a casing of insulation to reduce the heat loss to the room. The air-lock gate 48 is fed an input stream of material (not in view) from an overhead supply pipe which is encased inside an annular water jacket. The water jacket is circulated with hot water to pre-heat the infeed material before being introduced by the air-lock gate 48 into the vacuum drying chamber 25'. In like fashion, the air supply for chamber 25' including the air injectors is also pre-heated by surrounding the air manifold/pipes in water jackets serviced by hot water.

Figure 12:
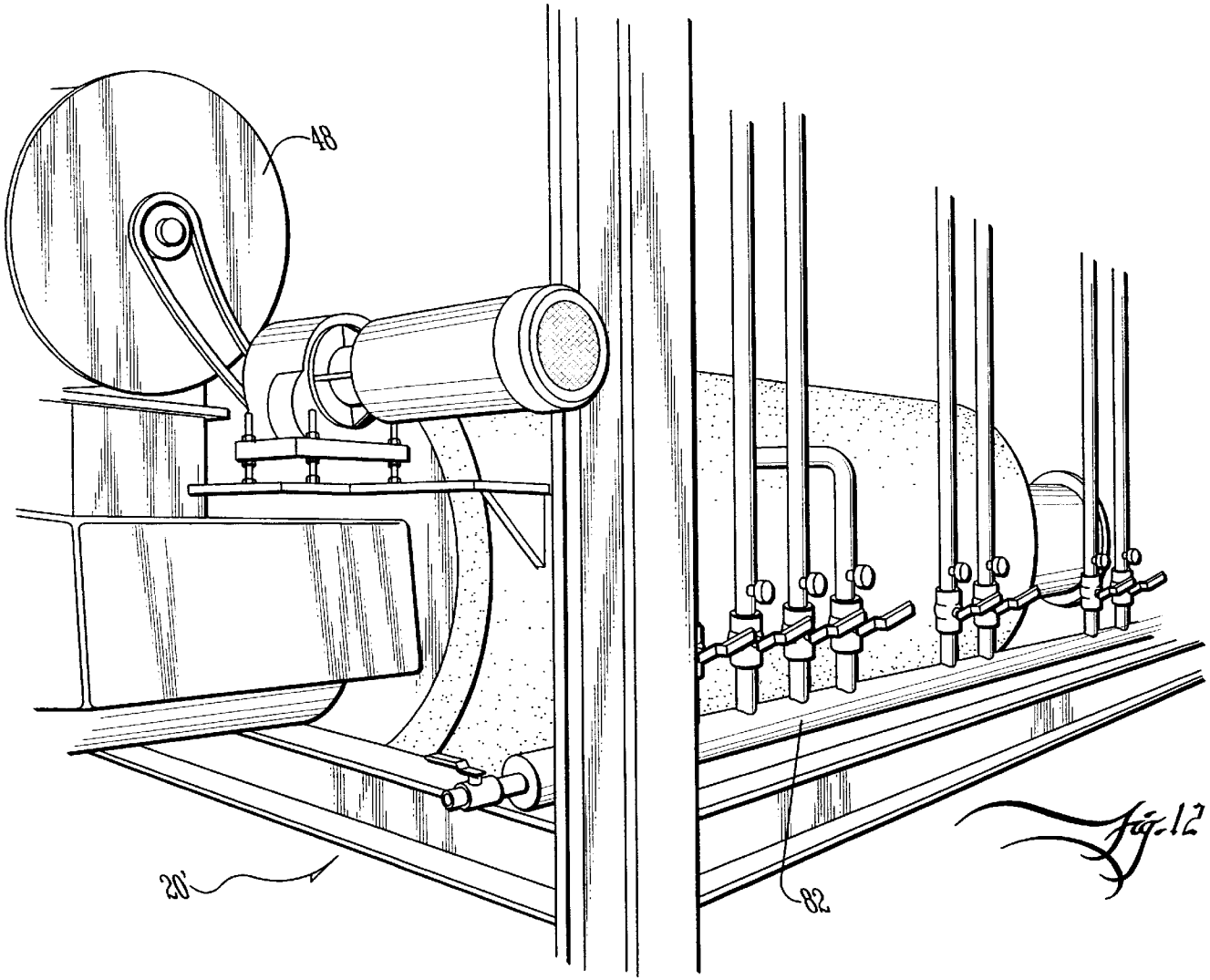
FIG. 12 is a pictorial view of the FIG. 11 embodiment except from a vantage point comparable to FIG. 2.

FIG. 12 is a pictorial view of the FIG. 11 embodiment 20' except from a vantage point comparable to FIG. 2. This view show aspects of a hot-water manifold 82 for supplying the hot water feed to the various water jackets of the invention.

Figure 13:
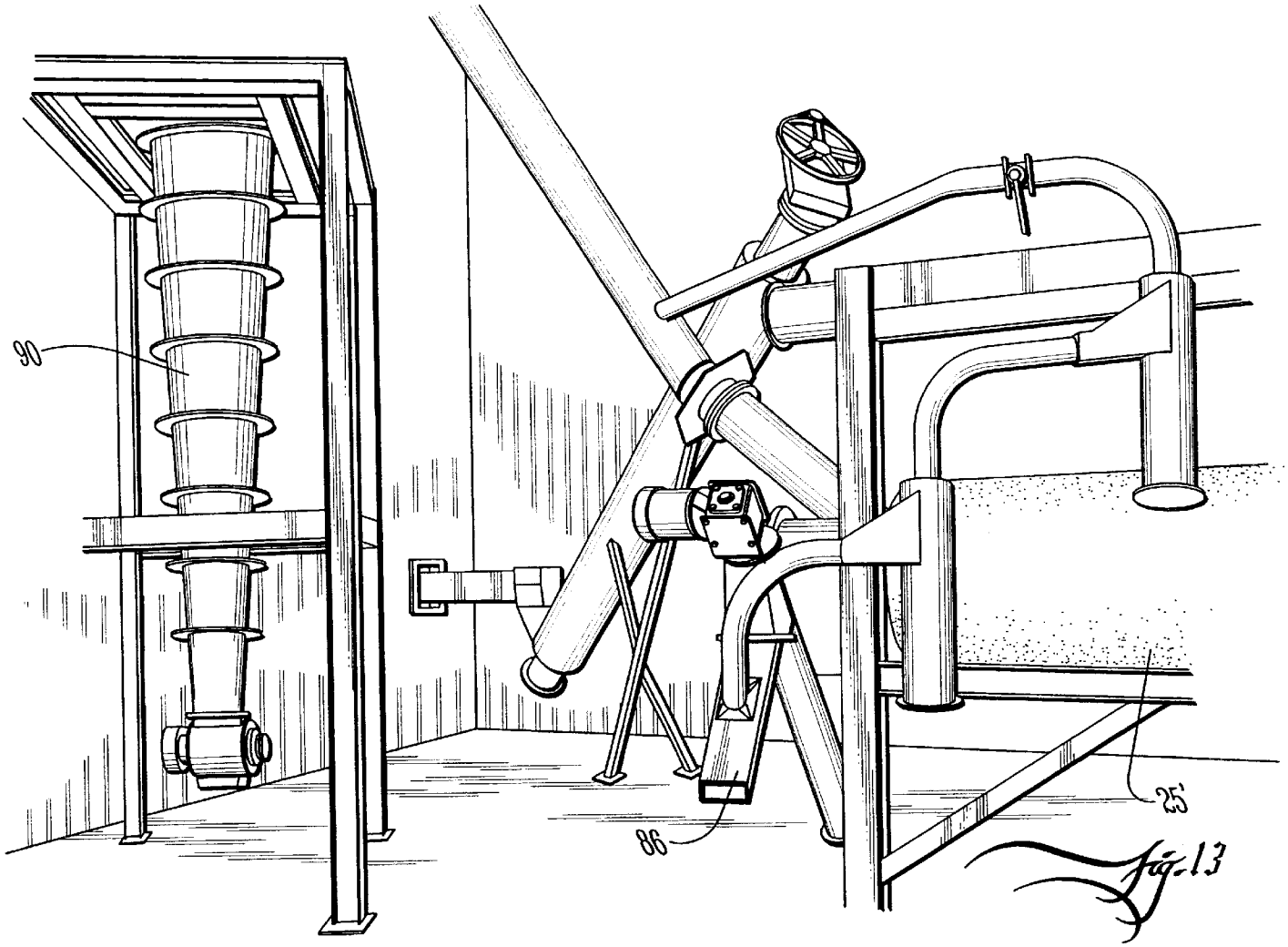
Figure 14:
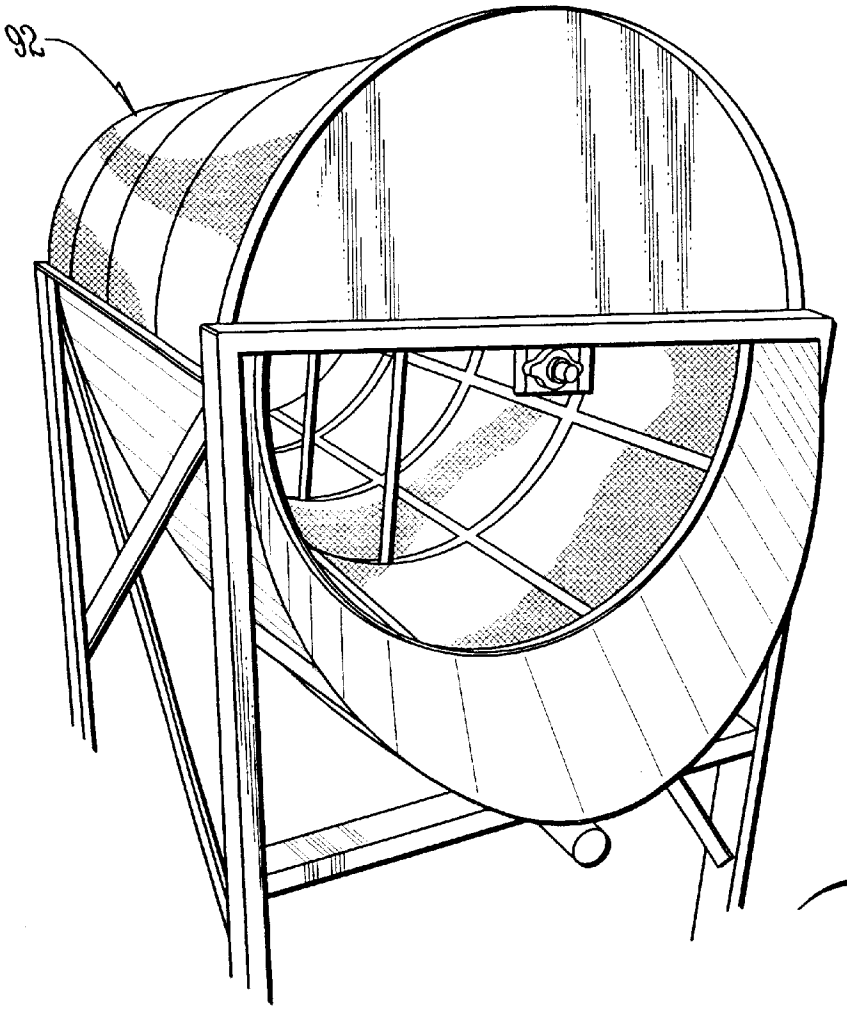
Figure 15:
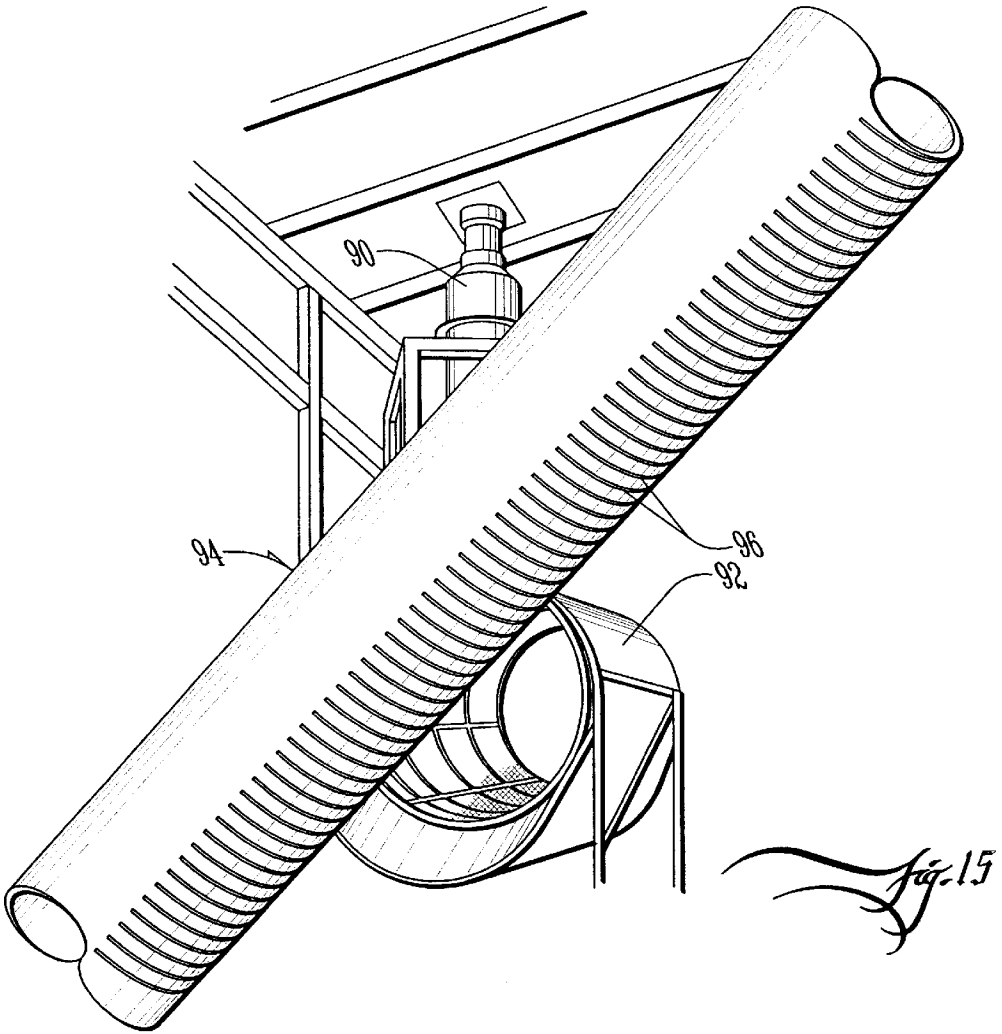

FIGS. 13 through 15 comprise a series of views to show post-auger chamber (eg., 25') treatment of the suctioned out material.

More particularly, the apparatus shown by FIGS. 13 through 15 illustrate various devices and arrangements thereof in accordance with the invention which are especially adapted for separating egg shell and egg membrane fractions after the auger chamber (eg. 25') vacuum drying treatment.

FIG. 13 is a side pictorial view of an exhaust or discharge end of the vacuum drying chamber 25'. This view shows that the vacuum manifold services at least two streams of suctioned-out or discharge fractions. One stream is gathered from low-elevation suction ports in the chamber 25' and by weight-fraction more heavily comprises the relatively-irreducible solid fractions of the input material which neither gasify nor pulverize sufficiently to swirl up and drawn through relatively higher elevation if not overhead suction ports. This such solid fraction is separated quickly at the beginning of the separation stages by a settling process assisted by one or more mini cyclones and of course gravity. This such solid fraction settles down to a low elevation where it is fed into the intake of an inclined auger conveyor. Midway up the inclined auger conveyor this solid stream is allowed to spill over a lip and down a chute 86 formed with an air gate to preserve the vacuum inside the chamber 25'. This solid fraction comprises substantially pure shell matter.

In contrast, the other fraction of the discharge comprises not only gasified and/or vapor components but also finely divided particulate as well as other "waftable" matter such as membranous matter. The finely divided particulate and membranous matter is a mixture which is mostly membrane, except also comprising shell dust and bits as well as a composite material that comprises membrane pieces which as yet persistently hold onto shell bits. This other fraction of gasified and/or vapor components as well as finely divided particulate and membranous material is drawn out through a relatively large cyclone 90 as shown for separating into diverse streams:—namely, one stream substantially comprises the throughput air as well as the gasified and/or vapor fractions, as the other stream substantially comprises the finely divided particulate and membranous matter.

FIG. 14 is a pictorial view of a succeeding separation apparatus following the FIG. 13 apparatus (ie., namely the spill-out from the relatively larger cyclone 90). This view shows a "crumble screen" or, in other words, a drum-type tumbling screen 92. The drum-type tumbling screen rotates and has a mesh size chosen to allow the filtering-out of shell dust and bits while passing on the fractional portions that comprise membrane as well as the membrane pieces which persistently hold onto shell bits.

FIG. 15 is a pictorial view of yet another successive separation apparatus following the FIG. 14 apparatus (ie., namely the drum-type tumbling screen 92). This view shows an inclined pipe 94 ventilated with a series of axially-spaced scrape slots 96 along its bottom. This ventilated pipe 94 contains an internal flex auger (not in view) which transports the infeed material up the incline, from an origin comprising a lower intake port to a termination comprising an upper discharge end. The transported material is scraped across the series of axially-spaced slots 96 to achieve further dropping out of shell dust and bits. More significantly, this achieves further disengagement between membrane and retained shell bits. The output of this ventilated pipe 94 yields substantially pure membrane.

The membrane recovered by the method in accordance with the invention is useful for other processes not encompassed by the invention for extracting collagen. The membrane provided by the inventive method is substantially if not absolutely pathogen-free. The collagen which can be extracted from the membrane is useful for many end-uses including by way of a non-limiting example for mixing into consumer shampoo products.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A method of vacuum drying sludge or slurry input material, comprising the steps of:

providing a chamber that is horizontally elongated between first and second ends with at least two elongated augers as well as one and another transfer arrangements;

providing the chamber with an interior bed portion that is recessed with at least two adjacent troughs separated by a low partition and is sized and arranged for accommodating the at least two augers in closely-spaced generally-horizontal side-by-side relation, wherein the augers extend between the chamber's first and second ends such that one auger defines a primary run for motivating material from the first to the second end as the other auger defines a return run for motivating material back from the second to the first end;

providing the second end of the chamber with the one transfer arrangement for transferring material in the primary run motivated up thereagainst to go over to the return run, and providing the first end with the other transfer arrangement for transferring material in the return run motivated up thereagainst to go back over to the primary run whereby material re-circulates in the primary and return runs in an endless loop;

given a source for suctioning, suctioning a current of carrier gas into the chamber by introduction through in-let nozzles and suctioning out a composite of let-in current and fractions of the material through suction ports such that an evacuated pressure in the chamber is achieved down to or below essentially $4/5^{ths}$ an atmosphere;

introducing the sludge or slurry input material into the chamber for re-circulation in the primary and return runs with an air-lock device for preserving the evacuated pressure;

given a source of heat, applying heat to the chamber or at least the bed portion thereof and optionally pre-heating the introduced material and let-in carrier gas to achieve a mean temperature inside the chamber up to or above essentially 75° C.;

providing each auger with spaced flights on the screws thereof to form cut-and-fold arrangements therewith to agitate the material and driving the augers to counter-rotate relative each other to adapt each auger for lofting portions of the agitated material at the other over the low partition therebetween;

wherein the effects of heat, evacuation, agitation and current through the chamber causes the input slurry or sludge material to disintegrate into fractions comprising gasified fractions, waftable finely divided particulate fractions, other waftable fractions and, depending on the input material, in some cases irreducible heavy or sticky fractions whereby the flowrate and introduction of the carrier gas is selected to substantially mix with or entrain the gasified, waftable finely divided particulate and other waftable fractions and carry such out through the suction ports.

2. The method of claim 1 further comprising introducing the input material in regulated measures such that as substantial fractions of preceding measures of input material are reduced and carried out of the process chamber through the suction ports a succeeding measure is introduced.

3. The method of claim 2 wherein the first end comprises an infeed end for the input material.

4. The method of claim 1 wherein the augers comprise shafts for supporting the screws thereof, and the one transfer arrangement comprises terminating the screw on the primary auger to form a gap with the second end and filling the gap with one or more paddles mounted to the primary auger's shaft, and the other transfer arrangement comprises terminating the screw on the return auger to form a gap with the first end and filling the gap with one or more paddles mounted to the return auger's shaft whereby the paddles kick material over to the other auger's run.

5. The method of claim 4 further comprising inserting a grinder intermediate each transfer arrangement's paddles and the respective other run whereby the paddle-kicked over material is ground through a grinder before reaching the respective other run.

6. The method of claim 1 wherein the source for suctioning comprises a vacuum pump and the carrier gas comprises air.

7. The method of claim 1 wherein the in-let nozzles comprise two series of nozzles such that one series is aimed directly into one of the primary and return runs at axially spaced locations as the other series of nozzles is aimed directly into the other of the primary or return runs to promote mixing with or entrainment of the gasified or waftable fractions of the disintegrating material.

8. The method of claim 1 wherein the evacuated pressure in the chamber is preferably achieved down to or below essentially $2/3^{rds}$ an atmosphere.

9. The method of claim 1 wherein the mean temperature inside the chamber is achieved up to or above essentially 90° C.

10. The method of claim 1 wherein the air-lock device comprises a vane or gear pump.

11. The method of claim 1 wherein the source of heat comprises a thermal fluid and the step of applying heat comprises forming a fluid jacket around the structure to which heat is applied.

12. The method of claim 11 wherein the thermal fluid comprises hot water and fluid or water jackets are formed around at least the base portion of the chamber as well as optionally around piping for the infeed material and piping for the in-let carrier gas.

13. The method of claim 1 further comprising ceasing operation of the chamber at selected times and releasing the evacuated pressure in order to perform maintenance including cleaning out the irreducible heavy or sticky fractions of the input material.

14. A method of vacuum drying input material comprising at least egg shell as well as egg membrane components and according to claim 1, further comprising piping the matter drawn through the suction ports through a cyclone to separate an exhaust stream and retention stream therefrom wherein the exhaust stream comprises substantially the carrier gas and the gasified fractions of the input material whereas the retention stream comprises substantially the waftable finely divided particulate and other waftable fractions.

15. The method of claim 14 further comprising feeding the retention stream through a screen-element separator to separate therefrom a fine stream and a coarse stream wherein the coarse stream comprises substantially the other waftable fraction and not nearly any of the finely divided particulate fraction.

16. The method of claim 15 wherein the screen-element separator comprises a drum-type tumbling screen.

17. The method of claim 15 further comprising feeding comprising an arrangement of scraper and apertured scraping surface to which the coarse stream is fed for separating into a preferred stream dropping through the apertured scraping surface and a less-preferred stream scraped aside from the scraping surface wherein the preferred stream comprises substantially if absolutely pathogen-free membrane.

18. A vacuum treatment process for separating derivative products from an input stream of waste egg shell materials and obtaining at least one output stream of substantially pieces of the soft membrane portion of the waste egg shells and at least another output stream of substantially particles of the hard mineral portion thereof, comprising the steps of:

introducing the input materials through a vacuum-preserving device into a vacuum treatment chamber that is horizontally elongated between first and second ends with at least two elongated augers as well as one and another transfer arrangements;

providing the chamber with an interior bed portion that is recessed with at least two adjacent troughs separated from one another by a low partition and sized and arranged for accommodating the at least two augers in closely-spaced generally-horizontal side-by-side relation, wherein the augers extend between the chamber's first and second ends such that one auger defines a primary run for motivating material from the first to the second end as the other auger defines a return run for motivating material back from the second to the first end;

providing the second end of the chamber with the one transfer arrangement for transferring material in the primary run motivated up thereagainst to go over to the return run, and providing the first end with the other transfer arrangement for transferring material in the return run motivated up thereagainst to go back over to the primary run whereby material re-circulates in the primary and return runs in an endless loop;

given a source for suctioning, suctioning a current of carrier gas into the chamber by introduction through in-let nozzles and suctioning out a composite of let-in current and fractions of the material through suction ports such that an evacuated pressure in the chamber is achieved down to or below essentially $4/5^{ths}$ an atmosphere;

given a source of heat, applying heat to the chamber or at least the bed portion thereof and optionally pre-heating the introduced material and let-in carrier gas to achieve a mean temperature inside the chamber up to or above essentially 75° C.;

providing the augers with cut-and-fold arrangements in order to agitate the material, and driving the augers relative each other to adapt each auger for lofting portions of the agitated material at the other over the low partition therebetween;

wherein the effects of heat, evacuation, agitation and current through the chamber causes the input materials to disintegrate into fractions comprising gasified fractions, suctionable finely divided particulate fractions, other suctionable fractions and, depending on the input material, in some cases irreducible heavy or sticky fractions whereby the flowrate and introduction of the carrier gas is selected to substantially mix with or entrain the gasified, suctionable finely divided particulate and other suctionable fractions and suction such out through the suction ports.

19. The process of claim 18, further comprising feeding the matter drawn through the suction ports to a cyclone to separate an exhaust stream and retention stream therefrom wherein the exhaust stream comprises substantially the carrier gas and the gasified fractions of the input material whereas the retention stream comprises substantially the suctionable finely divided particulate and other suctionable fractions, and, feeding the retention stream, through a screen-element separator to separate therefrom a fine stream and a coarse stream wherein the coarse stream comprises substantially the other suctionable fraction and not nearly any of the, finely divided particulate fraction, which makes up the fine stream, the fine stream comprising substantially hard mineral portion of egg shells.

20. The process of claim 19 further comprising an arrangement of scraper and apertured scraping surface to which the coarse stream is fed for separating into a preferred stream dropping through the apertured scraping surface and a less-preferred stream scraped aside from the scraping surface wherein the preferred stream comprises substantially if not absolutely pathogen-free pieces of membrane portion of egg shells.

* * * * *